US011125089B2

(12) United States Patent
Bertini et al.

(10) Patent No.: US 11,125,089 B2
(45) Date of Patent: Sep. 21, 2021

(54) TURBINE INCORPORATING ENDWALL FENCES

(71) Applicants: General Electric Company, Schenectady, NY (US); GE Avio S.r.l., Rivalta di Torino (IT)

(72) Inventors: Francesco Bertini, Frossasco (IT); Aspi Rustom Wadia, Loveland, OH (US); Lyle D. Dailey, Maineville, OH (US); Andrea Arnone, Florenece (IT); Filippo Rubechini, Florence (IT); Matteo Giovannini, Pratovecchio (IT); Paul Hadley Vitt, Liberty Township, OH (US); Jeffrey Donald Clements, Mason, OH (US)

(73) Assignees: General Electric Company, Schenectady, NY (US); GE Avio S.r.l., Rivolta di Torino (IT)

( * ) Notice: Subject to any disclaimer, the term of this patent is extended or adjusted under 35 U.S.C. 154(b) by 38 days.

(21) Appl. No.: 16/534,724

(22) Filed: Aug. 7, 2019

(65) Prior Publication Data

US 2020/0362713 A1 Nov. 19, 2020

(30) Foreign Application Priority Data

Aug. 8, 2018 (EP) ..... 18425066

(51) Int. Cl.
*F01D 9/04* (2006.01)
*F01D 5/14* (2006.01)

(52) U.S. Cl.
CPC ..... *F01D 9/041* (2013.01); *F01D 5/147* (2013.01); *F01D 5/145* (2013.01);
(Continued)

(58) Field of Classification Search
CPC ..... F01D 9/041; F01D 5/147; F01D 5/145; F05D 2240/122; F05D 2240/128;
(Continued)

(56) References Cited

U.S. PATENT DOCUMENTS 3,039,736 A 6/1962 Pon
3,193,185 A * 7/1965 Erwin ..... F01D 5/145 415/193

(Continued)

FOREIGN PATENT DOCUMENTS

DE 102009018924 A1 * 11/2010 ..... F01D 9/041
EP 1035302 9/2000

(Continued)

*Primary Examiner* — Justin D Seabe
*Assistant Examiner* — Theodore C Ribadeneyra
(74) *Attorney, Agent, or Firm* — McGarry Bair PC

(57) ABSTRACT

A turbomachinery apparatus includes: a turbine, including: a turbine component defining an arcuate flowpath surface; an array of axial-flow turbine airfoils extending from the flowpath surface, the turbine airfoils defining spaces therebetween; and a plurality of fences extending from the flowpath surface, in the spaces between the turbine airfoils, each fence having opposed concave and convex sides extending between a leading edge and a trailing edge, wherein the fences have a nonzero camber and a constant thickness, are axially located near the leading edges of adjacent turbine airfoils, and wherein at least one of a chord dimension of the fences and a span dimension of the fences is less than the corresponding dimension of the turbine airfoils.

20 Claims, 3 Drawing Sheets

(52) U.S. Cl.
CPC .. *F05D 2240/122* (2013.01); *F05D 2240/128* (2013.01); *F05D 2240/303* (2013.01); *F05D 2240/304* (2013.01); *F05D 2250/712* (2013.01)

(58) Field of Classification Search
CPC ..... F05D 2240/303; F05D 2240/304; F05D 2250/712; F05D 2240/121; F05D 2240/129
USPC ..... 415/194, 195, 914
See application file for complete search history.

(56) References Cited

U.S. PATENT DOCUMENTS 4,012,165 A 3/1977 Kraig
4,023,350 A * 5/1977 Hovan ..... F01D 5/145 60/39.5
4,420,288 A 12/1983 Bischoff
4,512,718 A 4/1985 Stargardter
5,275,531 A 1/1994 Roberts
6,478,545 B2 11/2002 Crall et al.
6,508,626 B1 * 1/2003 Sakurai ..... F04D 29/284 416/180
7,665,964 B2 2/2010 Taylor et al.
8,257,032 B2 * 9/2012 Beeck ..... F01D 9/00 415/191
8,303,258 B2 * 11/2012 Aubin ..... F04D 29/681 416/193 A
8,366,399 B2 2/2013 Allen-Bradley et al.
8,920,127 B2 * 12/2014 McCaffrey ..... F01D 5/3084 416/219 R
9,598,967 B2 3/2017 Xu
9,739,154 B2 8/2017 Derclaye et al.
9,745,850 B2 8/2017 Guendogdu et al.
9,874,221 B2 1/2018 DiPietro, Jr. et al.
10,267,170 B2 * 4/2019 Clark ..... F01D 9/06
10,385,871 B2 * 8/2019 Lurie ..... F04D 29/542
10,458,247 B2 * 10/2019 Charbonnier ..... F01D 5/142
10,746,131 B2 * 8/2020 Ramm ..... F01D 9/065
2007/0154314 A1 * 7/2007 Jarrah ..... F04D 29/327 416/203
2012/0051894 A1 3/2012 Clements et al.
2013/0051996 A1 2/2013 Hoeger et al.
2014/0328675 A1 * 11/2014 Derclaye ..... F04D 29/681 415/194
2014/0348660 A1 * 11/2014 Guendogdu ..... F01D 5/145 416/242
2016/0186772 A1 * 6/2016 DiPietro, Jr. ..... F04D 29/681 416/203
2016/0186773 A1 * 6/2016 DiPietro, Jr. ..... F04D 29/324 416/183
2017/0114796 A1 4/2017 DiPietro et al.
2018/0347582 A1 12/2018 Malmborg
2019/0024673 A1 1/2019 Anderson
2019/0178094 A1 6/2019 Schutte
2019/0186271 A1 6/2019 Xu et al.

FOREIGN PATENT DOCUMENTS

EP 2746534 6/2014
EP 3163028 5/2017
WO 2015142200 9/2015

* cited by examiner

TURBINE INCORPORATING ENDWALL FENCES

BACKGROUND OF THE INVENTION

This invention relates generally to turbines in gas turbine engines, and more particularly relates to rotor and stator airfoils of such turbines.

A gas turbine engine includes, in serial flow communication, a compressor, a combustor, and turbine. The turbine is mechanically coupled to the compressor and the three components define a turbomachinery core. The core is operable in a known manner to generate a flow of hot, pressurized combustion gases to operate the engine as well as perform useful work such as providing propulsive thrust or mechanical work. One common type of turbine is an axial-flow turbine with one or more stages each including a rotating disk with a row of axial-flow airfoils, referred to as turbine blades. Typically, this type of turbine also includes stationary airfoils alternating with the rotating airfoils, referred to as turbine vanes. The turbine vanes are typically bounded at their inner and outer ends by arcuate endwall structures.

During engine operation, the locus of stagnation points of the incident combustion gases extends along the leading edge of each airfoil in the turbine, and corresponding boundary layers are formed along the pressure and suction sides of each airfoil, as well as along each radially outer and inner endwall which collectively bound the four sides of each flow passage. In the boundary layers, the local velocity of the combustion gases varies from zero along the endwalls and airfoil surfaces to the unrestrained velocity in the combustion gases where the boundary layers terminate.

One common source of turbine pressure losses is the formation of horseshoe vortices generated as the combustion gases are split in their travel near the junction of an endwall and the leading edge of the blade. The static pressure increases along a streamline that reaches the blade leading edge from the upstream. As the free-stream velocity is higher than the velocity within the endwall boundary layer, the static pressure increases more in the free-stream region than near the endwall. As a result, a pressure gradient normal to the endwall is generated in the boundary layer at the junction of the blade leading edge and the endwalls. This spanwise pressure gradient causes a vortex roll-up and give rise to a pair of counter rotating horseshoe vortices which travel downstream on the opposite sides of each airfoil near the endwall.

The two vortices travel aft along the opposite pressure and suction sides of each airfoil and behave differently due to the different pressure and velocity distributions therealong. The interaction of the pressure and suction side vortices occurs near the mid-chord region of the airfoils and creates total pressure loss and a corresponding reduction in turbine efficiency. These vortices also create turbulence and increase undesirable heating of the endwalls.

Since the horseshoe vortices are formed at the junctions of turbine rotor blades and their integral root platforms, as well at the junctions of nozzle stator vanes and their outer and inner bands, corresponding losses in turbine efficiency are created, as well as additional heating of the corresponding endwall components.

Accordingly, there remains a need for an improved turbine stage for reducing horseshoe vortex affects.

BRIEF DESCRIPTION OF THE INVENTION

This need is addressed by a turbine which incorporates leading edge endwall fences in a blade and/or vane row thereof, to disrupt the movement of a horse-shoe vortex towards an adjacent airfoil.

According to one aspect of the technology described herein, a turbine apparatus includes: a turbine, including: a turbine component defining an arcuate flowpath surface; an array of axial-flow turbine airfoils extending from the flowpath surface, the turbine airfoils defining spaces therebetween; and a plurality of fences extending from the flowpath surface, in the spaces between the turbine airfoils, each fence having opposed concave and convex sides extending between a leading edge and a trailing edge, wherein the fences have a nonzero camber and a constant thickness, are axially located near the leading edges of adjacent turbine airfoils, and wherein at least one of a chord dimension of the fences and a span dimension of the fences is less than the corresponding dimension of the turbine airfoils.

According to another aspect of the technology described herein, a turbine apparatus includes: a turbine rotor stage including a disk rotatable about a centerline axis, the disk defining a rotor flowpath surface, and an array of axial-flow turbine blades extending outward from the rotor flowpath surface, the turbine blades defining spaces therebetween; a turbine nozzle stage including at least one wall defining a stator flowpath surface, and an array of axial-flow turbine vanes extending away from the stator flowpath surface, the turbine vanes defining spaces therebetween; and wherein at least one of the rotor or nozzle stages includes an array of fences extending from at least one of the flowpath surfaces thereof, the fences disposed in the spaces between the turbine blades or turbine vanes of the corresponding stage, wherein the fences have a nonzero camber and a constant thickness, are axially located near the leading edges of adjacent turbine blade or turbine vanes, and wherein at least one of a chord dimension of the fences and a span dimension of the fences is less than the corresponding dimension of the turbine blades or turbine vanes.

BRIEF DESCRIPTION OF THE DRAWINGS

The invention may be best understood by reference to the following description taken in conjunction with the accompanying drawing figures in which.

DETAILED DESCRIPTION OF THE INVENTION

Figure 1:
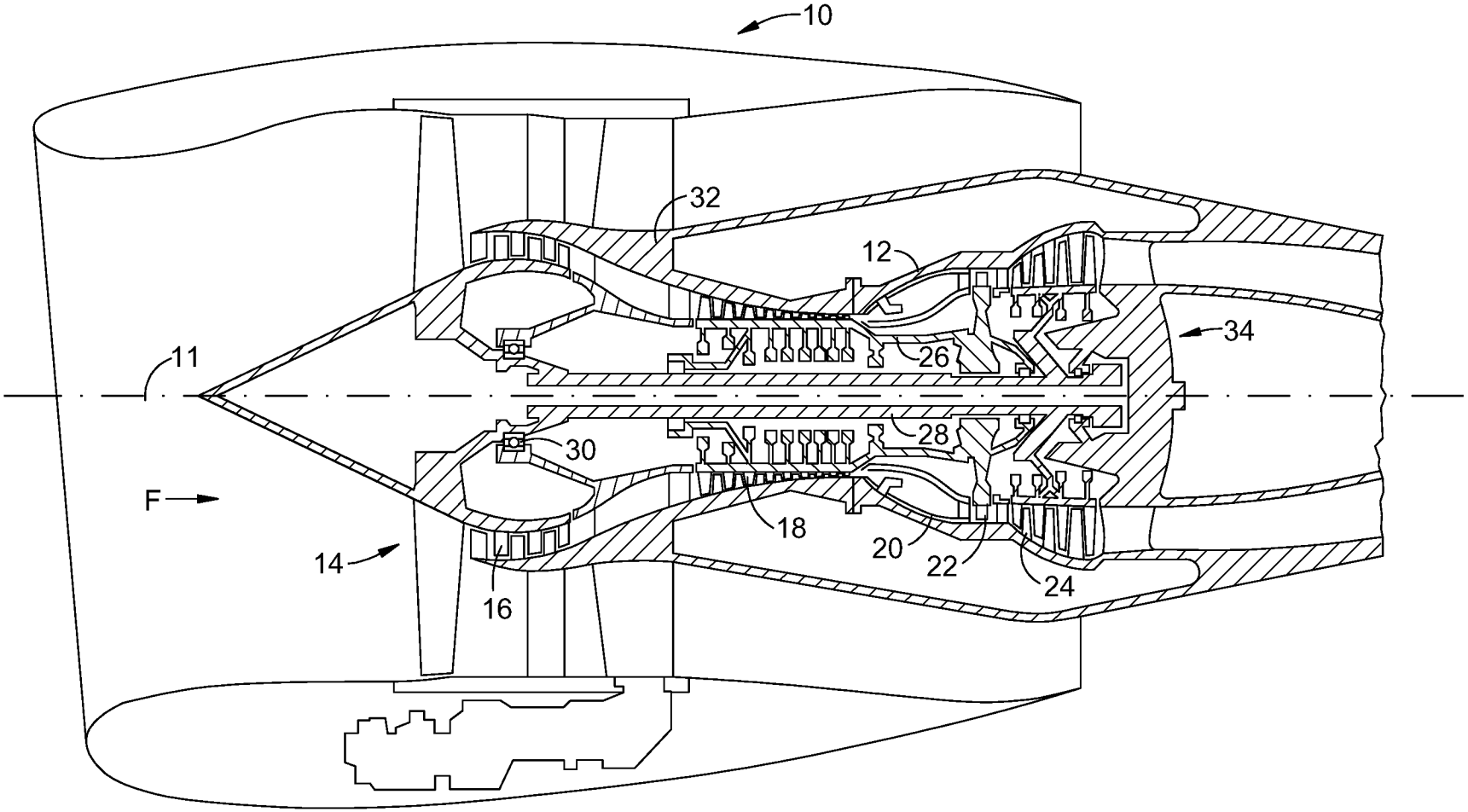
FIG. 1 is a cross-sectional, schematic view of a gas turbine engine that incorporates a turbine with fences.

Referring to the drawings wherein identical reference numerals denote the same elements throughout the various views, FIG. 1 depicts an exemplary gas turbine engine 10. While the illustrated example is a high-bypass turbofan engine, the principles of the present invention are also applicable to other types of engines, such as low-bypass turbofans, turbojets, turboprops, etc. The engine 10 has a longitudinal center line or axis 11 and a stationary core casing 12 disposed concentrically about and coaxially along the axis 11.

It is noted that, as used herein, the terms "axial" and "longitudinal" both refer to a direction parallel to the centerline axis 11, while "radial" refers to a direction perpendicular to the axial direction, and "tangential" or "circumferential" refers to a direction mutually perpendicular to the axial and radial directions. As used herein, the terms "forward" or "front" refer to a location relatively upstream in an air flow passing through or around a component, and the terms "aft" or "rear" refer to a location relatively downstream in an air flow passing through or around a component. The direction of this flow is shown by the arrow "F" in FIG. 1. These directional terms are used merely for convenience in description and do not require a particular orientation of the structures described thereby.

The engine 10 has a fan 14, booster 16, compressor 18, combustor 20, high pressure turbine or "HPT" 22, and low-pressure turbine or "LPT" 24 arranged in serial flow relationship. In operation, pressurized air from the compressor 18 is mixed with fuel in the combustor 20 and ignited, thereby generating combustion gases. Some work is extracted from these gases by the high-pressure turbine 22 which drives the compressor 18 via an outer shaft 26. The combustion gases then flow into the low-pressure turbine 24, which drives the fan 14 and booster 16 via an inner shaft 28. The inner and outer shafts 28 and 26 are rotatably mounted in bearings 30 which are themselves mounted in a fan frame 32 and a turbine rear frame 34.

FIGS. 2-6 illustrate a portion of an exemplary turbine rotor 36 suitable for inclusion in the HPT 22 or the LPT 24. While the concepts of the present invention will be described using the HPT 22 as an example, it will be understood that those concepts are applicable to any of the turbines in a gas turbine engine. As used herein, the term "turbine" refers to turbomachinery elements in which kinetic energy of a fluid flow is converted to rotary motion.

The rotor 36 includes a disk 38 including an annular flowpath surface 40 extending between a forward end 42 and an aft end 44. An array of turbine blades 46 extend from the flowpath surface 40. The turbine blades 46 constitute "turbine airfoils" for the purposes of this invention. Each turbine blade 46 extends from a root 48 at the flowpath surface 40 to a tip 50 and includes a concave pressure side 52 joined to a convex suction side 54 at a leading edge 56 and a trailing edge 58. The adjacent turbine blades 46 define spaces 60 therebetween.

The turbine blades 46 are uniformly spaced apart around the periphery of the flowpath surface 40. A mean circumferential spacing "s" (see FIG. 2) between adjacent turbine blades 46 is defined as $s=2\pi r/Z$, where "r" is a designated radius of the turbine blades 46 (for example at the root 48) and "Z" is the number of turbine blades 46.

Figure 3:
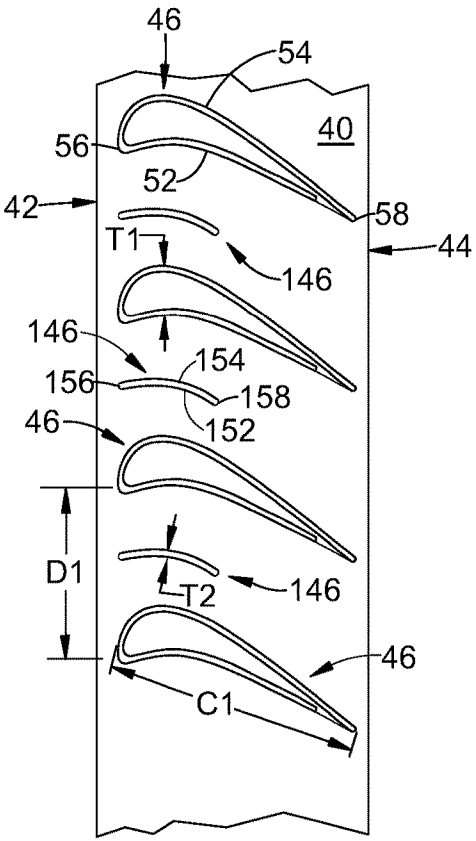
FIG. 3 is a top plan view of the rotor of FIG. 2.
Figure 4:
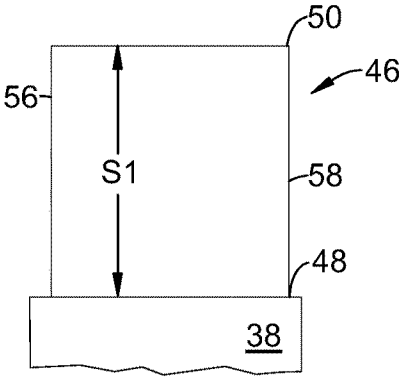
FIG. 4 is a side view of a turbine blade shown in FIG. 2.
Figure 7:
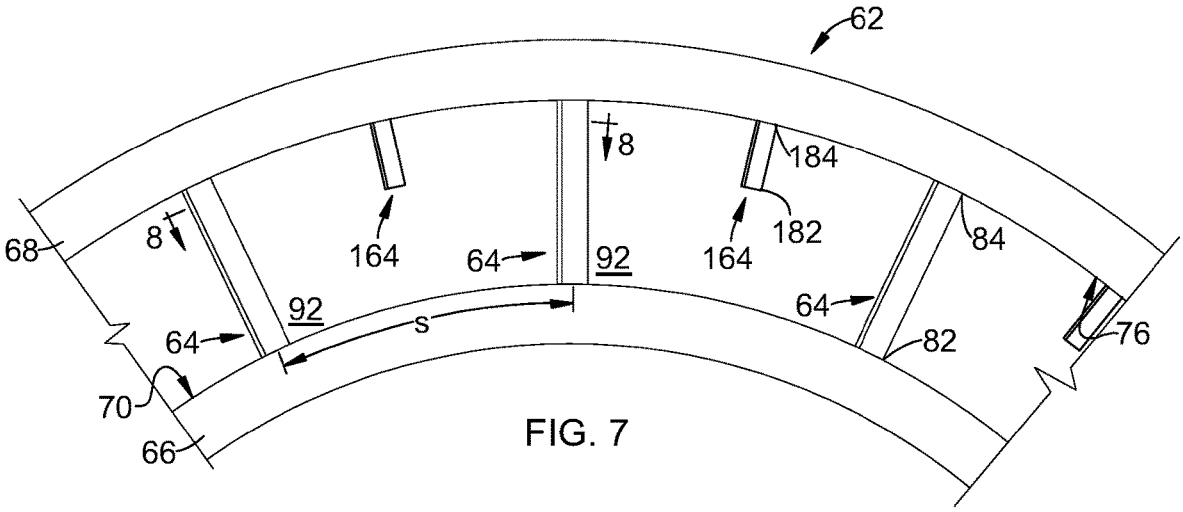
FIG. 7 is a front elevation view of a portion of a turbine nozzle assembly suitable for inclusion in the engine of FIG. 1.

As best seen in FIG. 4, each turbine blade 46 has a span (or span dimension) "S1" defined as the radial distance from the root 48 to the tip 50. Depending on the specific design of the turbine blade 46, its span S1 may be different at different axial locations. For reference purposes a relevant measurement is the span S1 at the leading edge 56. Each turbine blade 46 has a chord (or chord dimension) "C1" (FIG. 3) defined as the length of an imaginary straight line connecting the leading edge 56 and the trailing edge 58. Depending on the specific design of the turbine blade 46, its chord C1 may be different at different locations along the span S1. For purposes of the present invention, the relevant measurement is the chord C1 at the root 48, i.e. adjacent the flowpath surface 40.

Each turbine blade 46 has a thickness "T1" defined as the distance between the pressure side 52 and the suction side 54 (see FIG. 3). A "thickness ratio" of the turbine blade 46 is defined as the maximum value of the thickness T1, divided by the chord length, expressed as a percentage.

An array of fences 146 (FIG. 2) extend from the flowpath surface 40. One fence is disposed in each of the spaces 60 between the turbine blades 46. Each fence 146 extends from a root 148 at the flowpath surface 40 to a tip 150 and includes a concave side 152 joined to a convex side 154 at a leading edge 156 and a trailing edge 158.

The tangential position of the fences 146 relative to the turbine blades 46 may be described by reference to the tangential position of its leading edge 156. In one example, the leading edge 156 may be located within the range of 25% to 75% of the tangential distance "D2" measured between adjacent turbine blade leading edges 56, where the leading edge 56 of one turbine blade 46 represents 0% and the adjacent turbine blade represents 100%. In another example, the tangential position of the leading edge 156 may be located within the range of 40% to 60% of the tangential distance D between adjacent turbine blades 46.

The axial position of the fences 146 relative to the turbine blades 146 may be described by reference to the axial position of its leading edge 156. The axial position of the fences 146 may be varied to suit a particular application. In one example, the leading edge 156 of the fence 146 may be located within the range of −30% to 30% of the chord C1 of the turbine blades 46 adjacent the flowpath surface 40. In another example, the leading edge 156 of the fence 156 may be located within the range of 0 to 10% of the chord dimension C1 of the turbine blades 46 adjacent the flowpath surface 40. In this nomenclature, negative values represent fence leading edge locations axially forward of the leading edge 56 of the turbine blades 46, and positive values represent fence leading edge locations aft of the leading edge 56 of the turbine blades 46. ("0%" in this notation represents the leading edges 156 and 52 being at the same axial position). In the example shown in FIGS. 2-6, the fences 146 are positioned so that their leading edges 156 are at approximately the same axial position as the leading edges 56 of the turbine blades 46.

Figure 5:
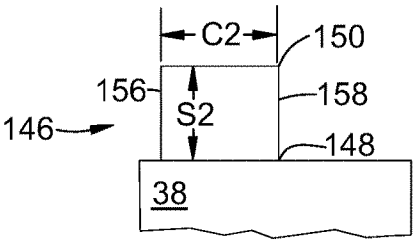
FIG. 5 is a side view of a fence shown in FIG. 2.

As best seen in FIG. 5, each fence 146 has a span (or span dimension) "S2" defined as the radial distance from the root 148 to the tip 150. Depending on the specific design of the fence 146, its span S2 may be different at different axial locations. For reference purposes a relevant measurement is the span S2 at the leading edge 156. Each fence 146 has a chord (or chord dimension) "C2" defined as the length of an imaginary straight line connecting the leading edge 156 and the trailing edge 158. Depending on the specific design of the fence 146, its chord C2 may be different at different locations along the span S2. For purposes of the present invention, the relevant measurement is the chord C2 at the root 148, i.e. adjacent the flowpath surface 40.

The fences 146 function to reduce pressure losses by blocking or disrupting the tendency of the pressure-side (PS) horse-shoe vortex leg to move towards the adjacent profile suction-side (SS). The dimensions of the fences 146 and their position may be selected to control secondary flow while minimizing their surface area.

Each fence 146 has a thickness "T2" (FIG. 3) defined as the distance between the concave side 152 and the convex side 154. A "thickness ratio" of the fence 146 is defined as the maximum value of the thickness T2, divided by the chord C2, expressed as a percentage. In general, the thickness of the fences 146 should be as small as possible consistent with structural, thermal, and aeroelastic considerations. For best performance in disrupting the vortex, they should have a constant thickness from leading edge 156 to trailing edge 158. Generally, the fences 146 should have a thickness ratio significantly less than a thickness ratio of the turbine blades 46. As one example, the fences 146 may have a constant thickness, in the range of half the diameter "d1" of the turbine blade trailing edge 58, to three times the diameter of the turbine blade trailing edge 58. This equates to a thickness ratio of about 0.1% to 0.6%. For comparison purposes, this is substantially less than the thickness of the turbine blades 46. For example, the turbine blades 46 may be about 30% to 40% thick. Other turbine blades within the engine 10, such as in the LPT 24, may be about 5% to 10% thick.

Figure 6:
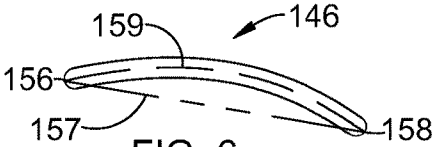
FIG. 6 is an enlarged end view of a fence shown in FIG. 3.
Figure 2:
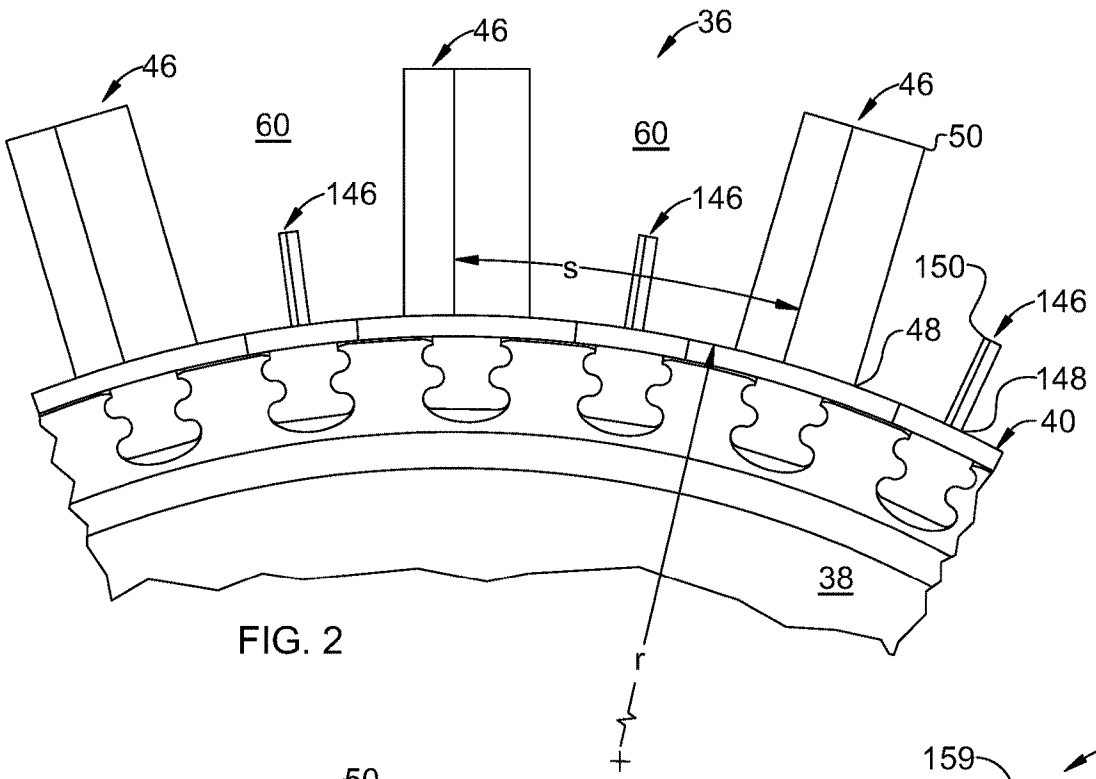
FIG. 2 is a front elevation view of a portion of a turbine rotor suitable for inclusion in the engine of FIG. 1.

For best performance in disrupting the vortex, the fences 146 should be aerodynamically "unloaded", that is, configured so they produce little or no aerodynamic lift. Accordingly, they should be cambered to follow the streamlines of the flow field surrounding the turbine blades 46. The parameter called "camber" describes the curvature of the cross-sectional shape of an airfoil. Referring to FIG. 6, for each individual airfoil section of the fence 146, an imaginary straight line referred to as a "chord line" 157 connects the leading edge 158 and the trailing edge 158. Also, for each individual airfoil section of the fence 146, a curve called the "camber line" 159 represents the locus of points lying halfway between the concave and convex sides 152, 154. The camber is often described in terms of the deflection or distance of the camber line 159 from the chord line 157. A large distance between the two lines is a large camber; conversely, a small distance is a small camber. The shape of the flow field streamlines may be determined via analysis or testing. For example, commercially available computational fluid dynamics ("CFD") solver software operates using a software representation (e.g. solid model) of a physical structure which is exposed to a fluid flow.

The span S2 and/or the chord C2 of the fences 146 are some fraction less than unity of the corresponding span S1 and chord C1 of the turbine blades 46. These may be referred to as "part-span" and/or "part-chord" fences. For example, the span S2 may be equal to or less than the span S1. In one example, the span S2 of the fences 146 is 30% or less of the span S2 of the turbine blades 46. In another example, the span S2 of the fences 146 is 2.5% to 10% of the span S2 of the turbine blades 46. In one example, example, the chord C2 may be 30% to 70% of the chord dimension of the turbine blades 46 adjacent the flowpath surface. In another example, the chord C2 is about 50% of the chord C1.

The disk 38, turbine blades 46, and fences 146 may be constructed from any material capable of withstanding the anticipated stresses and environmental conditions in operation. Non-limiting examples of known suitable alloys include nickel- and cobalt-based alloys.

In FIGS. 2-5, the disk 38, turbine blades 46, and fences 146 are depicted as an assembly built up from separate components. The principles of the present invention are equally applicable to a rotor with airfoils configured as an integral, unitary, or monolithic whole. This type of structure may be referred to as a "bladed disk" or "blisk".

The fence concepts described above may also be incorporated into turbine stator elements within the engine 10. For example, FIGS. 7-10 illustrate a portion of a turbine nozzle 62 suitable for inclusion in the HPT 22 or the LPT 24.

The turbine nozzle 62 includes a row of airflow-shaped turbine vanes 64 bounded at inboard and outboard ends, respectively by an inner band 66 and an outer band 68. The turbine vanes 64 constitute "stator airfoils" for the purposes of this invention.

The inner band 66 defines an annular inner flowpath surface 70 extending between forward and aft ends 72, 74. The outer band 68 defines an annular outer flowpath surface 76 extending between forward and aft ends 78, 80. Each turbine vane 64 extends from a root 82 at the inner flowpath surface 70 to a tip 84 at the outer flowpath surface 76 and includes a concave pressure side 86 joined to a convex suction side 88 at a leading edge 90 and a trailing edge 92. The adjacent turbine vanes 46 define spaces 93 therebetween.

The turbine vanes 64 are uniformly spaced apart around the periphery of the inner flowpath surface 70. The turbine vanes 64 have a mean circumferential spacing "s" defined as described above (see FIG. 7).

Figure 9:
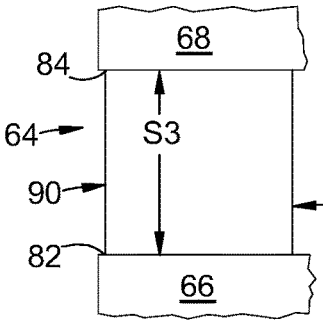
FIG. 9 is a side view of a stator vane shown in FIG. 7.

As best seen in FIG. 9, each turbine vane 64 has a span (or span dimension) "S3" defined as the radial distance from the root 82 to the tip 84. Depending on the specific design of the turbine vane 64, its span S3 may be different at different axial locations. For reference purposes a relevant measurement is the span S3 at the leading edge 90. Each turbine vane 64 has a chord (or chord dimension) "C3" defined as the length of an imaginary straight line connecting the leading edge 90 and the trailing edge 92. Depending on the specific design of the turbine vane 64, its chord C3 may be different at different locations along the span S3. For purposes of the present invention, the relevant measurement would be the chord C3 at the root 82 or tip 84, i.e. adjacent flowpath surfaces 70 or 76.

Each turbine vane 64 has a thickness "T3" defined as the distance between the pressure side 86 and the suction side 88 A "thickness ratio" of the turbine vane 64 is defined as the maximum value of the thickness T3, divided by the chord length, expressed as a percentage.

One or both of the inner and outer flowpath surfaces 70, 76 may be provided with an array of fences. In the example shown in FIG. 7, an array of fences 164 extend radially inward from the outer flowpath surface 76. A fence 164 is disposed between each pair of turbine vanes 64. In the circumferential direction, the fences 164 may be spaced uniformly or non-uniformly between two adjacent turbine vanes 64. Each fence 164 extends from a tip 184 at the outer flowpath surface 76 to a root 182 and includes a concave side 186 joined to a convex side 188 at a leading edge 190 and a trailing edge 192.

The tangential position of the fences 164 relative to the turbine vanes 64 may be described by reference to the tangential position of its leading edge 190. In one example, the leading edge 190 may be located within the range of 25% to 75% of the tangential distance "D2" measured between adjacent turbine vane leading edges 90, where the leading edge 90 of one turbine vane 64 represents 0% and the adjacent turbine vane represents 100%. In another example, the tangential position of the leading edge 190 may be located within the range of 40% to 60% of the tangential distance D2 between adjacent turbine vanes 64.

The axial position of the fences 164 relative to the turbine vanes 64 may be described by reference to the axial position of its leading edge 190. The axial position of the fences 164 may be varied to suit a particular application. In one example, the leading edge 190 of the fence 164 may be located within the range of −30% to 30% of the chord C3 of the turbine vanes 64 adjacent the flowpath surface 76. In another example, the leading edge 190 of the fence 164 may be located within the range of 0 to 10% of the chord dimension C3 of the turbine vanes 64 adjacent the flowpath surface 76. In this nomenclature, negative values represent fence leading edge locations axially forward of the leading edge 90 of the turbine vanes 64, and positive values represent fence leading edge locations aft of the leading edge 90 of the turbine vanes 64. ("0%" in this notation represents the leading edges 190 and 90 being at the same axial position). In the example shown in FIGS. 7-10, the fences 164 are positioned so that their leading edges 190 are at approximately the same axial position as the leading edges 90 of the turbine vanes 64.

Figure 10:
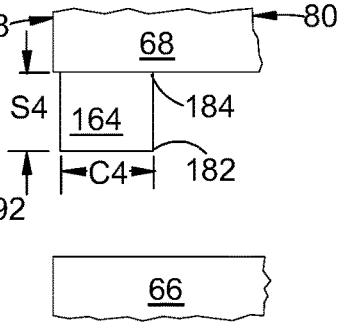
FIG. 10 is a side view of a fence shown in FIG. 7.
Figure 8:
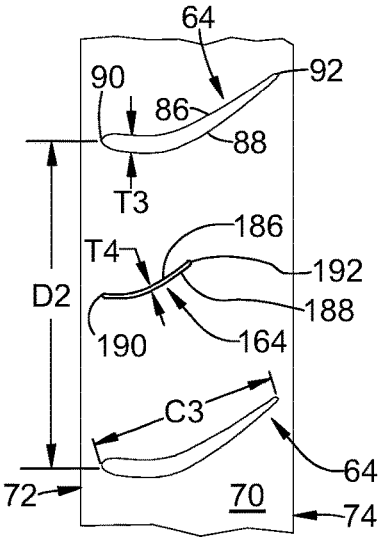
FIG. 8 is a view taken along lines 7-7 of FIG. 7.

As best seen in FIG. 10, each fence 164 has a span (or span dimension) "S4" defined as the radial distance from the root 182 to the tip 184, and a chord (or chord dimension) "C4" defined as the length of an imaginary straight line connecting the leading edge 190 and the trailing edge 192. Depending on the specific design of the fence 164, its chord C4 may be different at different locations along the span S4. For purposes of the present invention, the relevant measurement is the chord C4 at the tip 184, i.e. adjacent flowpath surface 76.

The fences 164 function to reduce pressure losses by blocking or disrupting the tendency of the pressure-side (PS) horse-shoe vortex leg to move towards the adjacent profile suction-side (SS). The dimensions of the fences 164 and their position may be selected to control secondary flow while minimizing their surface area.

Each fence 164 has a thickness "T4" (FIG. 8) defined as the distance between the concave side 186 and the convex side 188. A "thickness ratio" of the fence 146 is defined as the maximum value of the thickness T4, divided by the chord C4, expressed as a percentage. In general, the thickness of the fences 164 should be as small as possible consistent with structural, thermal, and aeroelastic considerations. For best performance in disrupting the vortex, they should have a constant thickness from leading edge 190 to trailing edge 192. Generally, the fences 194 should have a thickness ratio significantly less than a thickness ratio of the turbine vanes 64. As one example, the fences 164 may have a constant thickness, in the range of half the diameter "d2" of the turbine vane trailing edge 92, to three times the diameter of the turbine vane trailing edge 92. This equates to a thickness ratio of about 0.1% to 0.6%. For comparison purposes, this is substantially less than the thickness of the turbine vanes 64.

For best performance in disrupting the vortex, the fences 164 should be aerodynamically "unloaded", that is, configured so they produce little or no aerodynamic lift. Accordingly, they should be cambered to follow the streamlines of the flow field surrounding the turbine vanes 64, as described for the corresponding fences 46 above.

The span S4 and/or the chord C4 of the fences 146 are some fraction less than unity of the corresponding span S3 and chord C3 of the turbine vanes 64. These may be referred to as "part-span" and/or "part-chord" fences. For example, the span S4 may be equal to or less than the span S3. In one example, the span S4 of the fences 164 is 30% or less of the span S3 of the turbine vanes 64. In another example, the span S4 of the fences 164 is 2.5% to 10% of the span S3 of the turbine vanes 64. In one example, the chord C4 may be 30% to 70% of the chord C3 of the turbine vanes 64 adjacent the flowpath surface 76. In another example, the chord C4 is about 50% of the chord C3 adjacent the flowpath surface 76.

Figure 11:
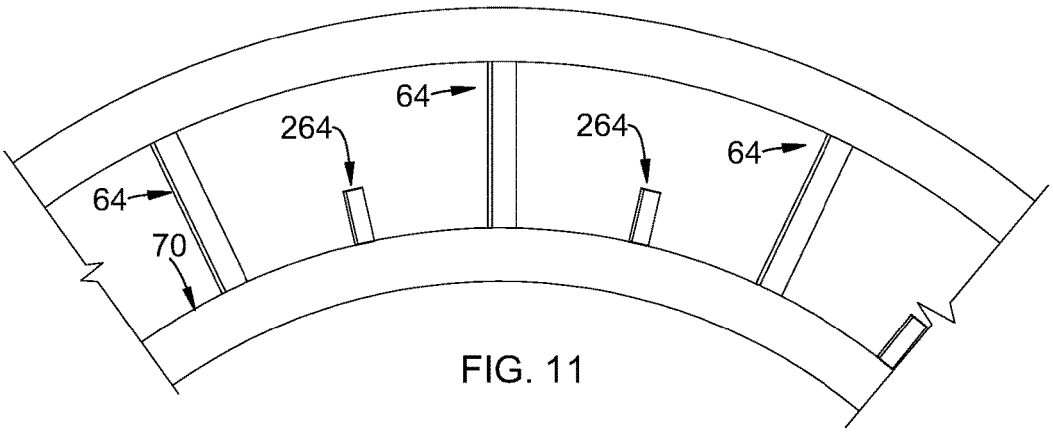
FIG. 11 is a front elevation view of a portion of an alternative turbine nozzle assembly suitable for inclusion in the engine of FIG. 1.

FIG. 11 illustrates an array of fences 264 extending radially outward from the inner flowpath surface 70. Other than the fact that they extend from the inner flowpath surface 70, the fences 264 may be identical to the fences 164 described above, in terms of their shape, axial and circumferential position relative to the stator vanes 64, their thickness, span, and chord dimensions, and their material composition. As noted above, fences may optionally be incorporated at the inner flowpath surface 70, or the outer flowpath surface 76, or both.

The turbine apparatus described herein incorporating has the technical effect and benefit, compared to the prior art, of reducing losses and flow turning deviations associated with the horse-shoe vortex, increasing turbine performance.

It is noted that, as used herein, the relative term "about" when describing a numerical value is intended to include sources of variation in the stated value, including but not limited to, measurement error and/or manufacturing variability. Accordingly, where not otherwise described, the relative term "about" encompasses the stated value, plus or minus 5% of the stated value.

The foregoing has described a turbine endwall fence apparatus. All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

What is claimed is:

1. A turbine apparatus, comprising:

a turbine, including:

a turbine component defining an arcuate flowpath surface;

an array of axial-flow turbine airfoils extending from the flowpath surface, the turbine airfoils spaced apart and defining a distance between two adjacent ones of the turbine airfoils, and each extending between a leading edge and a trailing edge; and a plurality of fences extending from the flowpath surface, in the spaces between the turbine airfoils, each fence having opposed concave and convex sides extending between a leading edge and a trailing edge, wherein the fences have a nonzero camber and a constant thickness, are axially located near the leading edges of adjacent turbine airfoils, and wherein at least one of a chord dimension of the fences and a span dimension of the fences is less than a corresponding span dimension of the turbine airfoils;

wherein the leading edge of each of the fences is axially positioned, relative to the leading edge of an adjacent one of the turbine airfoils, in a range of −30% to 30% of the chord dimension of the adjacent one of the turbine airfoils, and wherein the chord dimension of fences adjacent the flowpath surface is 30% to 70% of the chord dimension of the turbine airfoils adjacent the flowpath surface.

2. The apparatus of claim 1 wherein the leading edge of each of the fences is tangentially positioned within a range of 25% to 75% of the distance between two adjacent ones of the turbine airfoils.

3. The apparatus of claim 1 wherein the leading edge of each of the fences is tangentially positioned within a range of 40% to 60% of the distance between two adjacent ones of the turbine airfoils.

4. The apparatus of claim 1 wherein the leading edge of each of the fences is axially positioned, relative to the leading edge of an adjacent one of the turbine airfoils, in a range of 0% to 10% of the chord dimension of the adjacent one of the turbine airfoils.

5. The apparatus of claim 1 wherein the span dimension of the fences is 30% or less of the span dimension of the turbine airfoils.

6. The apparatus of claim 1 wherein the span dimension of the fences is 2.5% to 10% of the span dimension of the turbine airfoils.

7. The apparatus of claim 1 wherein the chord dimension of the fences adjacent the flowpath surface is about 50% of the chord dimension of the turbine airfoils adjacent the flowpath surface.

8. The apparatus of claim 1 wherein the fences have a thickness in the range of half a trailing edge diameter of the turbine airfoils, to three times the trailing edge diameter of the turbine airfoils.

9. The apparatus of claim 1 wherein the leading edge of each of the fences is axially positioned, relative to a leading edge of the adjacent one of the turbine airfoils, forward or aft of the leading edge of the adjacent one of the adjacent one of the turbine airfoils.

10. The apparatus of claim 1 wherein the leading edge of each of the fences is axially positioned, relative to the leading edge of an adjacent one of the corresponding turbine blades or turbine vanes, in a range of −30% to less than 30% of the chord dimension of the adjacent one of the turbine airfoils.

11. A turbine apparatus, comprising:

a turbine rotor stage including a disk rotatable about a centerline axis, the disk defining a rotor flowpath surface, and an array of axial-flow turbine blades extending outward from the rotor flowpath surface, the turbine blades spaced apart and defining a distance between two adjacent ones of the turbine blades, and each extending between a leading edge and a trailing edge;

a turbine nozzle stage including at least one wall defining a stator flowpath surface, and an array of axial-flow turbine vanes extending away from the stator flowpath surface, the turbine vanes spaced apart and defining a distance between two adjacent ones of the turbine vanes, and each extending between a leading edge and a trailing edge; and wherein at least one of the rotor or nozzle stages includes an array of fences extending from at least one of the flowpath surfaces thereof, each fence having a leading edge and a trailing edge, the fences disposed in the spaces between the turbine blades or turbine vanes of the corresponding stage, wherein the fences have a nonzero camber and a constant thickness, are axially located near the leading edges of adjacent turbine blade or turbine vanes, and wherein at least one of a chord dimension of the fences and a span dimension of the fences is less than a corresponding span dimension of the turbine blades or turbine vanes;

wherein the leading edge of each of the fences is axially positioned, relative to the leading edge of an adjacent one of the corresponding turbine blades or turbine vanes, in a range of −30% to 30% of the chord dimension of the adjacent one of the corresponding turbine blades or turbine vanes, and wherein the chord dimension of fences adjacent the flowpath surface is 30% to 70% of the chord dimension the turbine blades or turbine vanes adjacent the corresponding flowpath surface.

12. The apparatus of claim 11 wherein the leading edge of each of the fences is tangentially positioned within a range of 25% to 75% of the distance between two adjacent ones of the corresponding turbine blades or turbine vanes.

13. The apparatus of claim 11 wherein the leading edge of each of the fences is tangentially positioned within a range of 40% to 60% of the distance between two adjacent ones of the corresponding turbine blades or turbine vanes.

14. The apparatus of claim 11 wherein the leading edge of each of the fences is axially positioned, relative to the leading edge of an adjacent one of the corresponding turbine blades or turbine vanes, in a range of 0% to 10% of the chord dimension of the adjacent one of the corresponding turbine blades or turbine vanes.

15. The apparatus of claim 11 wherein the span dimension of the fences is 30% or less of the span dimension of the corresponding turbine blades or turbine vanes.

16. The apparatus of claim 11 wherein the span dimension of the fences is 2.5% to 10% of the span dimension of the corresponding turbine blades or turbine vanes.

17. The apparatus of claim 11 wherein the chord dimension of the fences adjacent the flowpath surface is 50% to 70% of the chord dimension of the corresponding turbine blades or turbine vanes adjacent the corresponding flowpath surface.

18. The apparatus of claim 11 wherein the chord dimension of the fences adjacent the flowpath surface is about 50% of the chord dimension of the corresponding turbine blades or turbine vanes adjacent the corresponding flowpath surface.

19. The apparatus of claim 11 wherein the fences have a thickness in the range of half a trailing edge diameter of the corresponding turbine blades or turbine vanes, to three times the trailing edge diameter of the corresponding turbine blades or turbine vanes.

20. The apparatus of claim 11 wherein the leading edge of each of the fences is axially positioned, relative to the leading edge of an adjacent one of the corresponding turbine blades or turbine vanes, forward or aft of the leading edge of the adjacent one of the corresponding turbine blades or turbine vanes.

* * * * *